US006422217B1

(12) United States Patent
Feucht et al.

(10) Patent No.: US 6,422,217 B1
(45) Date of Patent: Jul. 23, 2002

(54) BACK PRESSURE VALVE DRIVE EGR SYSTEM

(75) Inventors: Dennis D. Feucht, Morton; Eric C. Fluga, Dunlap; Keith E. Lawrence, Peoria; Carol A. Rathman, Farmington, all of IL (US)

(73) Assignee: Caterpillar Inc., Peoria, IL (US)

( * ) Notice: Subject to any disclaimer, the term of this patent is extended or adjusted under 35 U.S.C. 154(b) by 2 days.

(21) Appl. No.: 09/740,591

(22) Filed: Dec. 19, 2000

(51) Int. Cl.[7] ..... F02B 47/08

(52) U.S. Cl. ..... 123/568.11; 60/605.2; 123/568.12

(58) Field of Search ..... 123/568.11, 568.12; 60/605.2

(56) References Cited

U.S. PATENT DOCUMENTS

| | | | | |
|---|---|---|---|---|
| 3,925,989 A | | 12/1975 | Pustelnik | |
| 4,249,382 A | | 2/1981 | Evans et al. | |
| 4,474,008 A | | 10/1984 | Sakurai et al. | |
| 4,702,218 A | | 10/1987 | Yoshioka et al. | |
| 4,723,525 A | | 2/1988 | Fried et al. | |
| 5,205,265 A | | 4/1993 | Kashiyama et al. | |
| 5,440,880 A | | 8/1995 | Ceynow et al. | |
| 5,533,487 A | | 7/1996 | Cailey | |
| 5,611,204 A | * | 3/1997 | Radovanovic et al. | 60/605.2 |
| 5,669,365 A | | 9/1997 | Gartner et al. | |
| 5,740,785 A | | 4/1998 | Dickey et al. | |
| 5,771,867 A | | 6/1998 | Amstutz et al. | |
| 5,802,846 A | | 9/1998 | Bailey | |
| 5,806,308 A | | 9/1998 | Khair et al. | |
| 6,006,732 A | * | 12/1999 | Oleksiewicz | 123/568.11 |
| 6,102,014 A | * | 8/2000 | Donaldson | 123/568.12 |
| 6,164,071 A | * | 12/2000 | Shao et al. | 123/568.12 |
| 6,216,458 B1 | * | 4/2001 | Alger et al. | 123/568.12 |
| 6,216,677 B1 | * | 4/2001 | McConnell et al. | 123/568.12 |
| 6,263,672 B1 | * | 7/2001 | Roby et al. | 123/568.11 |
| 6,286,312 B1 | * | 9/2001 | Bertilsson | 123/568.12 |

* cited by examiner

*Primary Examiner*—Paul J. Hirsch
(74) *Attorney, Agent, or Firm*—Schwartz & Weinrieb

(57) ABSTRACT

An internal combustion engine exhaust gas recirculation (EGR) system includes an exhaust gas manifold back pressure valve insert assembly which has an exhaust gas recirculation (EGR) conduit interposed between exhaust manifold structure of the engine and atmospheric exhaust structure, and a valve mechanism disposed within the exhaust gas recirculation (EGR) conduit and movable between a fully closed position at which all exhaust gases from the engine pass to atmospheric exhaust through the atmospheric exhaust structure, and a fully opened position at which the valve mechanism partially occludes the atmospheric exhaust structure such that a sufficiently large back pressure is developed with respect to the atmospheric exhaust structure such that exhaust gases are forced through the exhaust gas recirculation (EGR) conduit.

21 Claims, 8 Drawing Sheets

BACK PRESSURE VALVE DRIVE EGR SYSTEM

TECHNICAL FIELD

The present invention relates generally to an internal combustion engines, and more particularly to a valve-controlled system for generating a sufficient back pressure within an engine exhaust system to force an engine exhaust gas into an engine intake manifold during an exhaust gas recirculation (EGR) mode.

BACKGROUND ART

During the exhaust gas recirculation (EGR) mode of an internal combustion engine, a flow path must be established from the engine exhaust gas manifold through the engine exhaust gas recirculation (EGR) cooler and into the engine intake manifold after having passed through the exhaust gas recirculation (EGR) cooler. The pressure generated within an exhaust gas recirculation (EGR) system must be high enough to force a desired portion of the exhaust gas into the intake manifold so as not to be exhausted or routed through the turbine side of the engine turbocompressor. Prior art systems have utilized pumps, venturis, and/or similar devices to create sufficient high pressure, back pressure, and/or differential pressure drops within the respective systems, however, such devices or components have considerable expenditures.

A need therefore exists in the art for a relatively simple and low-cost control mechanism which can be readily and easily used with the exhaust gas recirculation (EGR) system of an internal combustion engine. The exhaust gas recirculation (EGR) system must have sufficiently high pressure or back pressure to force the engine exhaust gas into the engine intake manifold properly enabling or facilitating the exhaust gas recirculation (EGR) mode for the engine.

DISCLOSURE OF THE INVENTION

In one aspect of the invention, an exhaust gas recirculation (EGR) system is adapted for use with an internal combustion engine. The exhaust gas recirculation (EGR) system has an exhaust gas recirculation (EGR) conduit interposed an exhaust manifold structure of the engine and an atmospheric exhaust structure. And, a valve mechanism is disposed within the exhaust gas recirculation (EGR) conduit and movable between a fully closed position at which an entrance to the exhaust gas recirculation (EGR) conduit is blocked and all exhaust gas from the engine passes to atmospheric exhaust through the atmospheric exhaust structure, and a fully opened position at which the valve mechanism opens the entrance to the exhaust gas recirculation (EGR) conduit and partially occludes the atmospheric exhaust structure such that a sufficiently large back pressure is developed with respect to the atmospheric exhaust structure such that exhaust gases are forced through the exhaust gas recirculation (EGR) conduit.

In another aspect of the invention, a method provides exhaust gas recirculation to an internal combustion engine. The internal combustion engine has a plurality of cylinders, an atmospheric exhaust structure, an intake manifold, a first exhaust manifold being in fluid communication with a first portion of the plurality of cylinders, and a second exhaust manifold being in fluid communication with a second portion of the plurality of cylinders. The method has the following steps. Providing a conduit interposed one of the first portion of the plurality of cylinders and the second portion of the plurality of cylinders and the intake manifold. Providing a valve mechanism in the conduit. Moving the valve mechanism into a closed position during an operating mode of the internal combustion engine so that an exhaust gas from the plurality of cylinders is directed to the atmospheric exhaust structure. Moving the valve mechanism into an open position during an operating mode of the internal combustion engine so that the exhaust gas from one of the first portion and the second portion creating a large back pressure with respect to an exhaust gas within the atmospheric exhaust structure and being directed to the intake manifold. And, moving the valve mechanism into a position intermediate the open position and the closed position during an operating mode of the internal combustion engine so that a predetermined quantity of the exhaust gas from one of the first portion and the second portion creating a large back pressure with respect to an exhaust gas within the atmospheric exhaust structure being directed to the intake manifold.

BEST MODE FOR CARRYING OUT THE INVENTION

Figure 1:
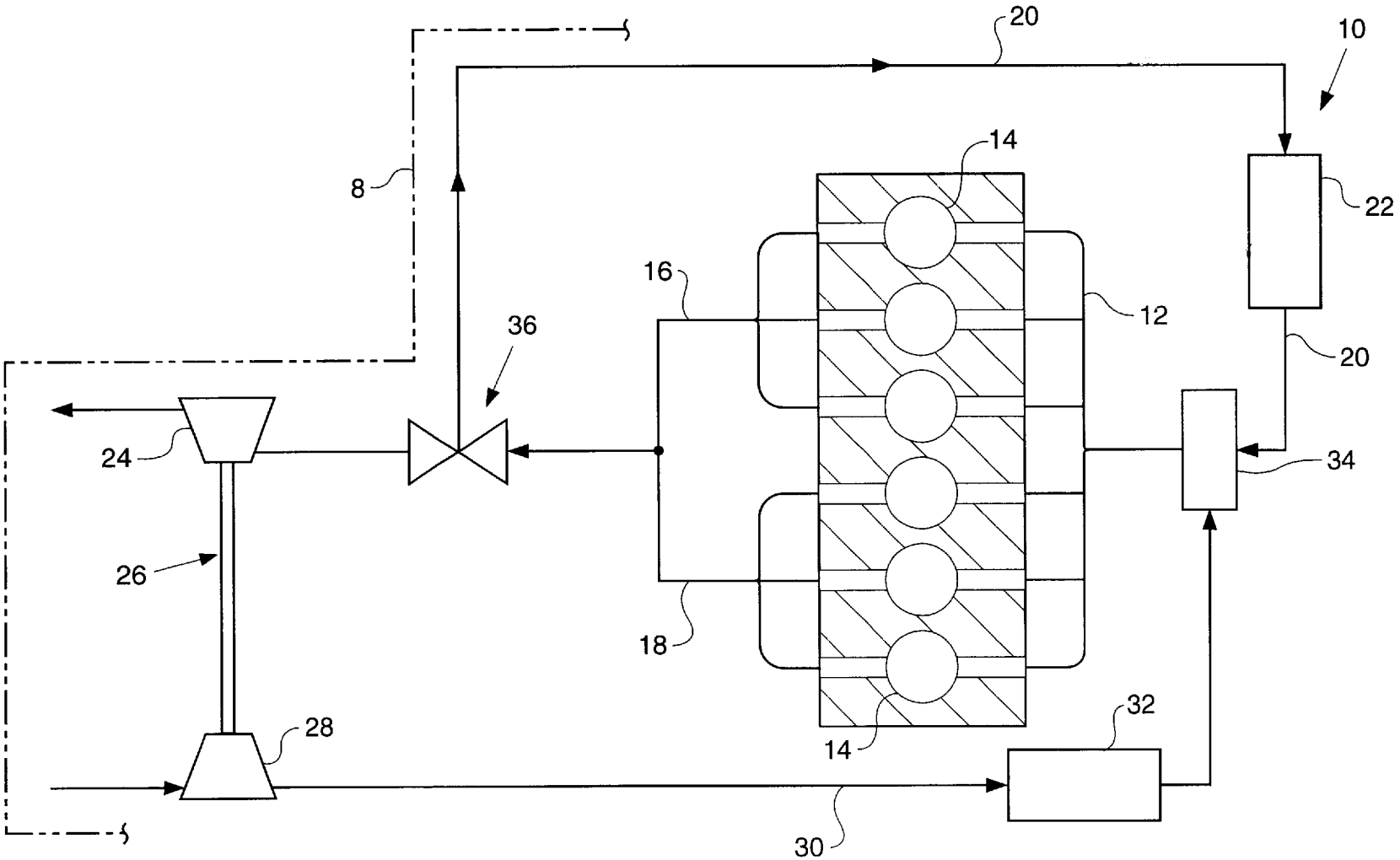
FIG. 1 is a schematic drawing of a high pressure exhaust gas recirculation (EGR) loop utilized in conjunction with an internal combustion engine embodying the present invention.

Referring to FIG. 1, an engine 8 is schematically shown and depicted by the phantom line. In this application, a six cylinder engine is described. However, it should be understood that a V-engine or another configuration of an engine can be used with the described exhaust gas recirculation (EGR) loop 10. The exhaust gas recirculation (EGR) loop 10 as shown has an intake manifold 12 of the engine 8 fluidically connected to a portion of a plurality of cylinders 14 of the engine 8. The six cylinder engine 8 has a pair of exhaust manifolds 16, 18 respectively being fluidically connected to a front bank or a first portion 16 of a plurality of the cylinders 14 and a rear banks or a second portion 18 of a plurality of the cylinders 14. The pair of exhaust manifolds 16, 18 are in turn respectively fluidically connected to an exhaust gas recirculation loop conduit 20 which leads to an exhaust gas recirculation (EGR) cooler 22, and to a turbine stage 24 of a turbocharger or turbocompressor 26. The turbine stage 24 of the turbocompressor 26 drives a compressor stage 28 of the turbocompressor 26. Intake air is driven into the intake manifold 12 through an intake air conduit 30 and an aftercooler 32. Exhaust gas is ultimately exhausted to atmosphere. Intake air and recirculation exhaust gas from conduits 20 and 30 are mixed together within a mixer 34 before being transmitted into the intake manifold 12. An exhaust gas recirculation (EGR) back pressure valve assembly 36 is disposed within the exhaust gas recirculation (EGR) loop conduit 20.

Figure 2:
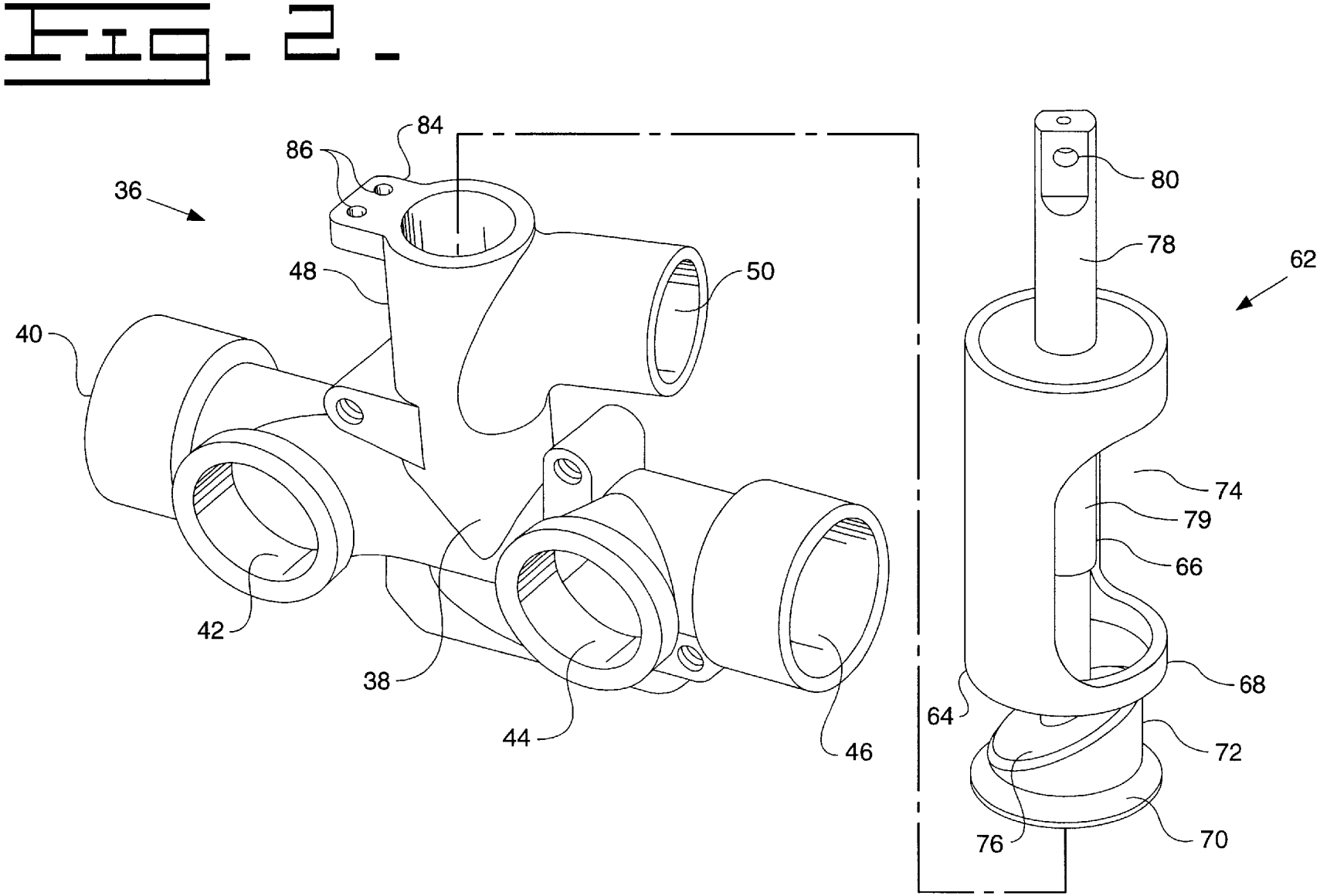
FIG. 2 is an enlarged, exploded view of an exhaust gas manifold back pressure valve insert assembly embodying the present invention.

As best shown in FIG. 2, the exhaust gas recirculation (EGR) back pressure valve assembly or valve mechanism 36, has a substantially T-shaped manifold 38 which has a first, horizontally disposed or extending inlet port or tubular conduit section 40 having exhaust gas from first and second ones of the six cylinders 14 is conducted. A second, horizontally disposed inlet port or tubular conduit section 42 is disposed substantially perpendicular to the first inlet port or conduit section 40. The inlet ports 40 and 42 have exhaust gas from a fourth one of the six cylinders 14 directed therethrough and to the exhaust gas recirculation (EGR) back pressure valve manifold 38. Exhaust gas from a third one of the six cylinders 14 is conducted to the exhaust gas recirculation (EGR) back pressure valve manifold 38. A third, horizontally disposed exhaust port or conduit 44 extends parallel to the second inlet port or conduit 42. The inlet port 42 has exhaust gas from a fourth one of the six cylinders 14 directed therethrough and to the exhaust gas recirculation (EGR) back pressure valve manifold 38. A fourth, horizontally disposed exhaust port or conduit 46 is disposed substantially coaxially with respect to the first inlet port or conduit 40 and substantially perpendicular to the third exhaust port or conduit 44. Exhaust gas from a fifth and sixth ones of the six engine cylinders 14 flows to the exhaust gas recirculation (EGR) back pressure valve manifold 38.

Figure 3:
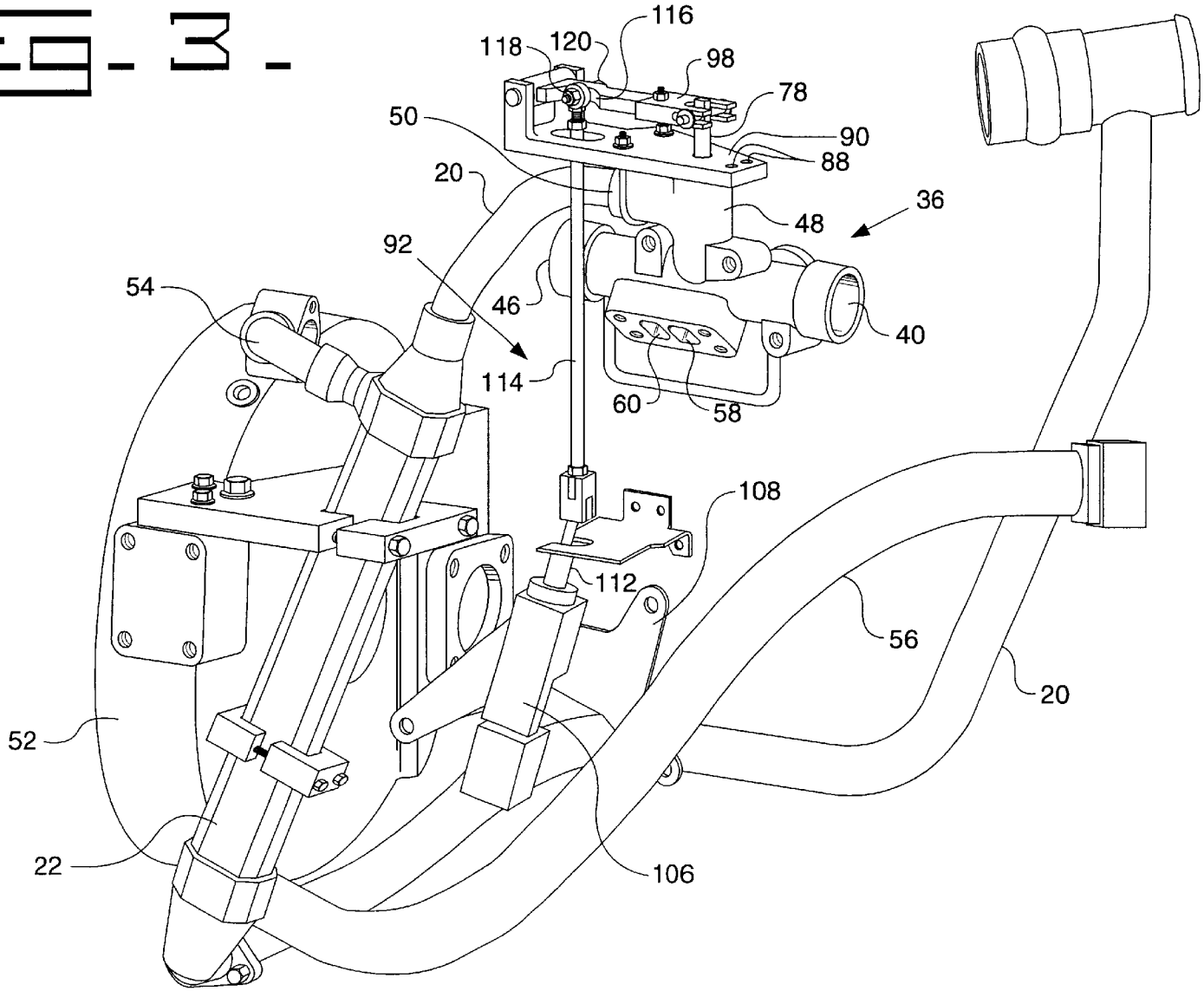
FIG. 3 is a partial right side perspective view of the exhaust gas recirculation (EGR) loop which is utilized in conjunction with an internal combustion engine and in part further defines the schematic drawing of the exhaust gas recirculation (EGR) loop shown in FIG. 1 embodying the present invention.
Figure 4:
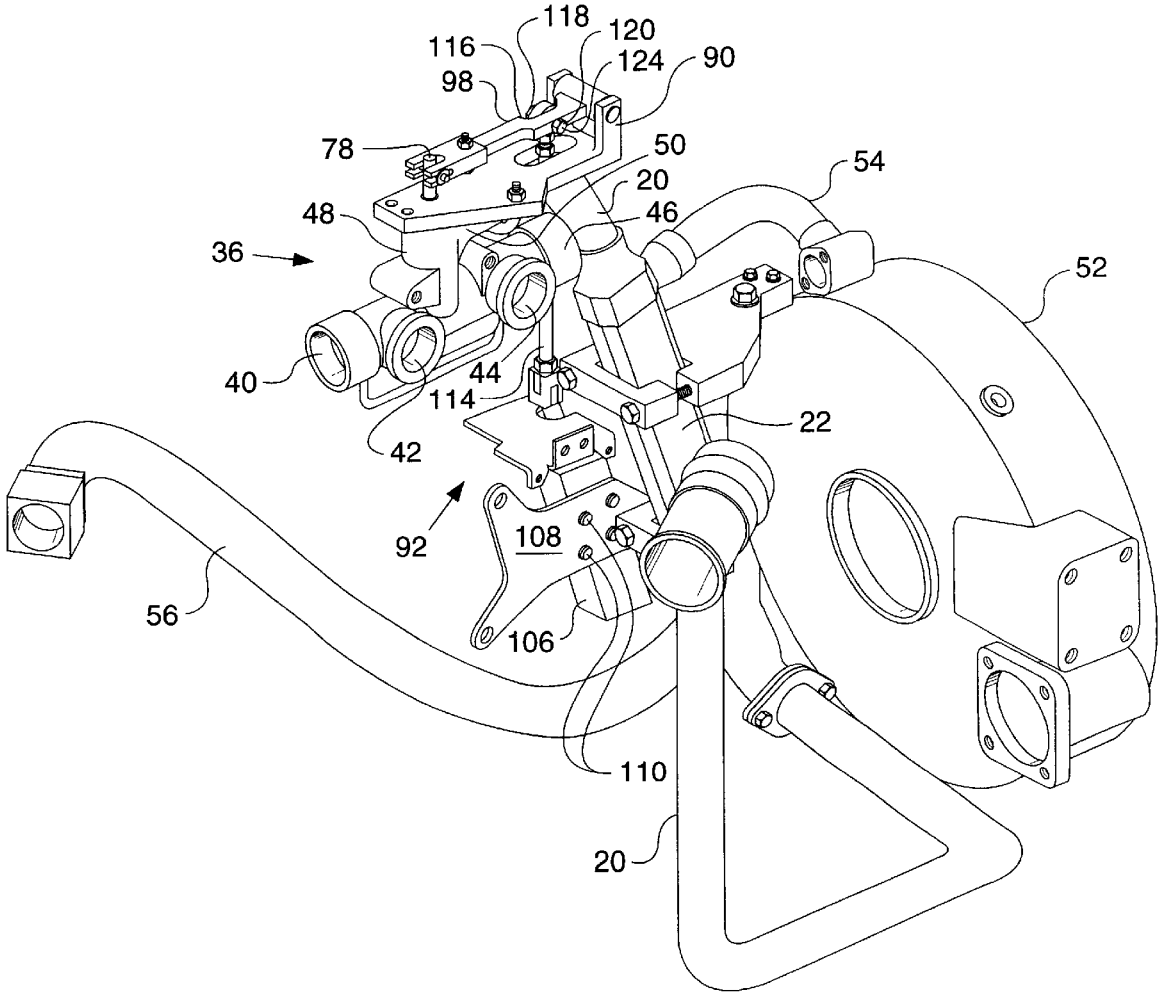
FIG. 4 is a partial left side perspective view of the exhaust gas recirculation (EGR) loop utilized in conjunction with an internal combustion engine as shown in, and corresponding to the exhaust gas recirculation loop of, FIG. 3.

As further shown in FIG. 2, the exhaust gas recirculation (EGR) back pressure valve manifold 38 has a vertically upstanding conduit or housing 48. A horizontally disposed exhaust port 50 is in fluidic communication with the vertically disposed valve housing 48 and serves to exhaust gas toward the exhaust gas recirculation (EGR) cooler 22 as shown in FIGS. 3 and 4 as well as FIG. 1. As best shown in FIGS. 1, 3 and 4, exhaust gas recirculation (EGR) back pressure valve assembly 36 is fluidically interconnected within the exhaust gas recirculation (EGR) loop 20. The exhaust gas recirculation (EGR) back pressure valve assembly 36 is also operatively associated with the other components of the combustion engine system.

As shown in FIGS. 3 and 4, the exhaust gas exhausted from the exhaust gas recirculation back pressure valve assembly 36 passes through the exhaust port 50 is conducted into the exhaust gas recirculation (EGR) loop 20 and into the exhaust gas recirculation (EGR) cooler 22. Cooling water from an engine block through an flywheel housing 52 is conducted into the EGR cooler 22 by a conduit 54. The cooling water and the hot exhaust gases are disposed in a heat exchange relationship within the EGR cooler 22. Cooled exhaust gases from the EGR cooler 22 pass through a downstream portion of the exhaust gas recirculation (EGR) loop 20 and are conducted into the mixer 34, as shown in FIG. 1. The heated water is conducted from the EGR cooler 22 through a conduit 56 and back to a water cooling circuit (not shown in it entirety). As an alternative, the EGR cooler 22 could be located in a waterjacket of the engine block or head without changing the jest of the invention.

As is also best seen in FIG. 3, the underside portion of the exhaust gas recirculation (EGR) back pressure valve manifold 38 includes two exhaust ports 58, 60 so as to respectively conduct exhaust gases from the front bank of cylinders, that is, from the first, second, and third cylinders, and from the rear bank of cylinders, that is, from the fourth, fifth, and sixth cylinders, to the turbine stage 24 of the turbocompressor 26. By providing the exhaust gas recirculation (EGR) back pressure valve subassembly, as will be more fully described hereinafter, the flow of the exhaust gases from the front bank of engine cylinders, that is, from the first, second, and third cylinders, can be variably modulated or adjustably controlled such that sufficient back pressure is developed within the system during exhaust gas recirculation (EGR) operative modes.

Referring again to FIG. 2, the exhaust gas recirculation (EGR) back pressure valve subassembly is adapted to be housed within the upstanding housing portion 48 of the exhaust gas recirculation (EGR) back pressure valve manifold 38 and is generally indicated by the reference character 62. The exhaust gas recirculation (EGR) back pressure valve subassembly has a valve cylinder or sleeve member 64, and a valve member 66 which is adapted to be vertically movable with respect to and within the valve sleeve member 64. The lower periphery of the valve sleeve member 64 defines a valve seat 68 upon which a peripheral engagement portion 70 of a valve head section or head portion 72 of the valve member 66 is adapted to be seated when the valve member 66 is disposed at its closed position. The valve sleeve member 64 further has an elongated exhaust port 74 which is defined within a side wall portion thereof. When the exhaust gas recirculation (EGR) back pressure valve subassembly 62 is axially disposed within the upstanding valve housing 48 of the exhaust gas recirculation (EGR) back pressure valve manifold 38, the exhaust gases to be recirculated for performance of exhaust gas recirculation (EGR) operative modes are able to be exhausted toward the exhaust port 50 of the valve manifold 38.

It is further noted that in order to facilitate the fluidic flow of the exhaust gases through the valve subassembly 62 and out through elongated exhaust port 74, the valve head section 72 of the valve member 66 has a surface portion 76. The surface portion 76 is inclined or sloped upwardly from a first elevational level which is substantially elevationally coincident with the peripheral valve seat engagement portion 70 of the valve member 66, to a second elevational level which is considerably above the peripheral valve seat engagement portion 70. The slope or inclination of the surface portion 76 extends from a lowermost height at a position diametrically opposite the exhaust port 74 to an uppermost height at a diametrical position corresponding to that of exhaust port 74. A valve stem 78 is integrally connected to the valve head section 72 and projects vertically upwardly therefrom. Vertical linear movement of the valve stem 78, as the valve member 66 is moved relative to the valve seat 68, is controlled or guided by a valve guide 79.

Figure 5:
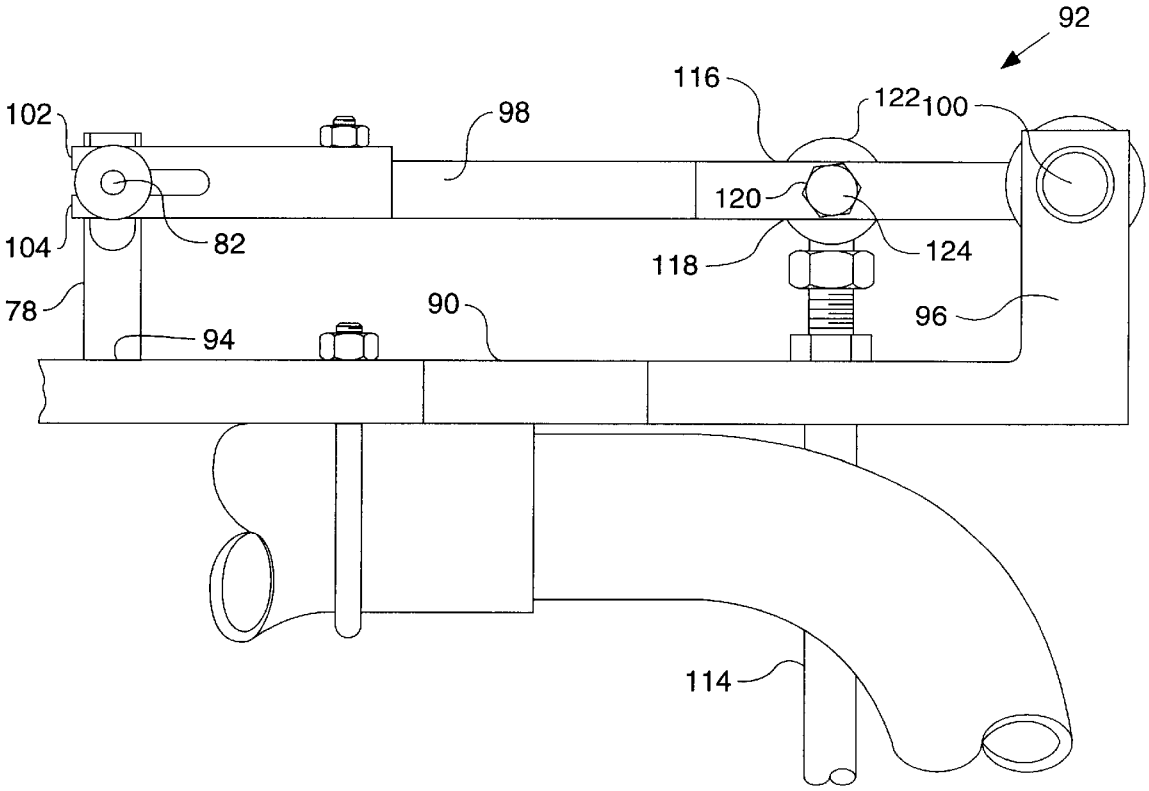
FIG. 5 is an enlarged perspective view showing a part of an actuation system for the exhaust gas manifold back pressure valve of the present invention as shown in FIG. 2.

With reference to FIGS. 2–5, the actuating system for variably adjusting or controllably activating the valve member 66 of the valve subassembly 62 will now be described. As best seen in FIG. 2, the upper end of the valve stem 78 has an aperture 80 defined therein. As best seen in FIG. 5, a rod 82 projects through the aperture 80 so as to be disposed transversely with respect to the axis of valve stem 78. The uppermost end portion of the valve housing portion 48 of the valve manifold 38 has a laterally extending flange portion 84. The valve manifold 38 is disposed diametrically opposite the exhaust port 50. A pair of threaded bores 86, 86 are defined within the flange portion 84 for accommodating bolt fasteners 88, 88 which are adapted to fixedly secure a support platform member 90 of an actuating system, generally indicated by the reference character 92, to the valve assembly 36.

The support platform 90 is provided with an aperture 94, as best seen in FIG. 5, through which the upper end portion of the valve stem 78 projects. The support platform 90 is provided with a clevis portion having a pair of upstanding ears 96, 96 at the end thereof which is remote from the valve stem 78. An actuating lever 98 has a first end thereof pivotally mounted upon the upstanding clevis ears 96, 96 by a clevis pin 100. And, the opposite end of the actuating lever 98 is provided with a pair of laterally or transversely separated clevis portions each one of which respectively has a pair of vertically separated clevis ears or clevis portions 102 and 104. It is thus seen from FIG. 5 that the upper end of the valve stem 78 projects vertically upwardly so as to be interposed the transversely spaced sets of clevis ears 102, 102 and 104, 104. In a similar manner, the horizontally projecting rod or dowel 82 of the valve stem 78 is interposed vertically spaced sets of the clevis ears 102, 104 and 102, 104. Consequently, as the actuating lever 98 is pivotally moved upwardly and downwardly about its pivot axis which is defined by the clevis pin 100, valve stem 78, as guided by the valve guide 79, and accordingly, valve head 72, are moved upwardly and downwardly with respect to the valve seat 68 so as to enable achievement of the opened and closed valve positions with respect to valve seat 68. An infinite number of intermediate valve positions are also provided, as will be more fully appreciated hereinafter.

In order to achieve the pivotal movement of the actuating lever 98, and the consequent linear vertical movement of the valve stem 78 and the valve head 72 relative to the valve seat 68, an electro-hydraulic actuator 106 of the actuating system 92 is operatively connected to the actuating lever 98 as best seen in FIGS. 3–5. More particularly, the electro-hydraulic actuator 106 is fixedly mounted upon a mounting bracket 108 by a plurality of bolt fasteners 110, and the mounting bracket 108 is, in turn, adapted to be fixedly mounted upon the engine block by suitable attaching devices, not shown.

The electro-hydraulic actuator 106 is of the type that as a result of receiving an electrical signal from a suitable source generator, not shown, emits a signal proportional to the amount or degree to which the valve 66 is to be opened or closed, hydraulic fluid is conducted into the actuator 106 so as to extend or contract a piston rod 112 thereof as best seen in FIG. 3. The upper end of the piston rod 112 is pivotally connected to the lower end of an actuator rod 114, and the upper end of the actuator rod 114 is pivotally mounted with respect to the actuating lever 98 within the vicinity of the clevis assembly comprising clevis ears 96, 96 and clevis pin 100.

Figure 6:
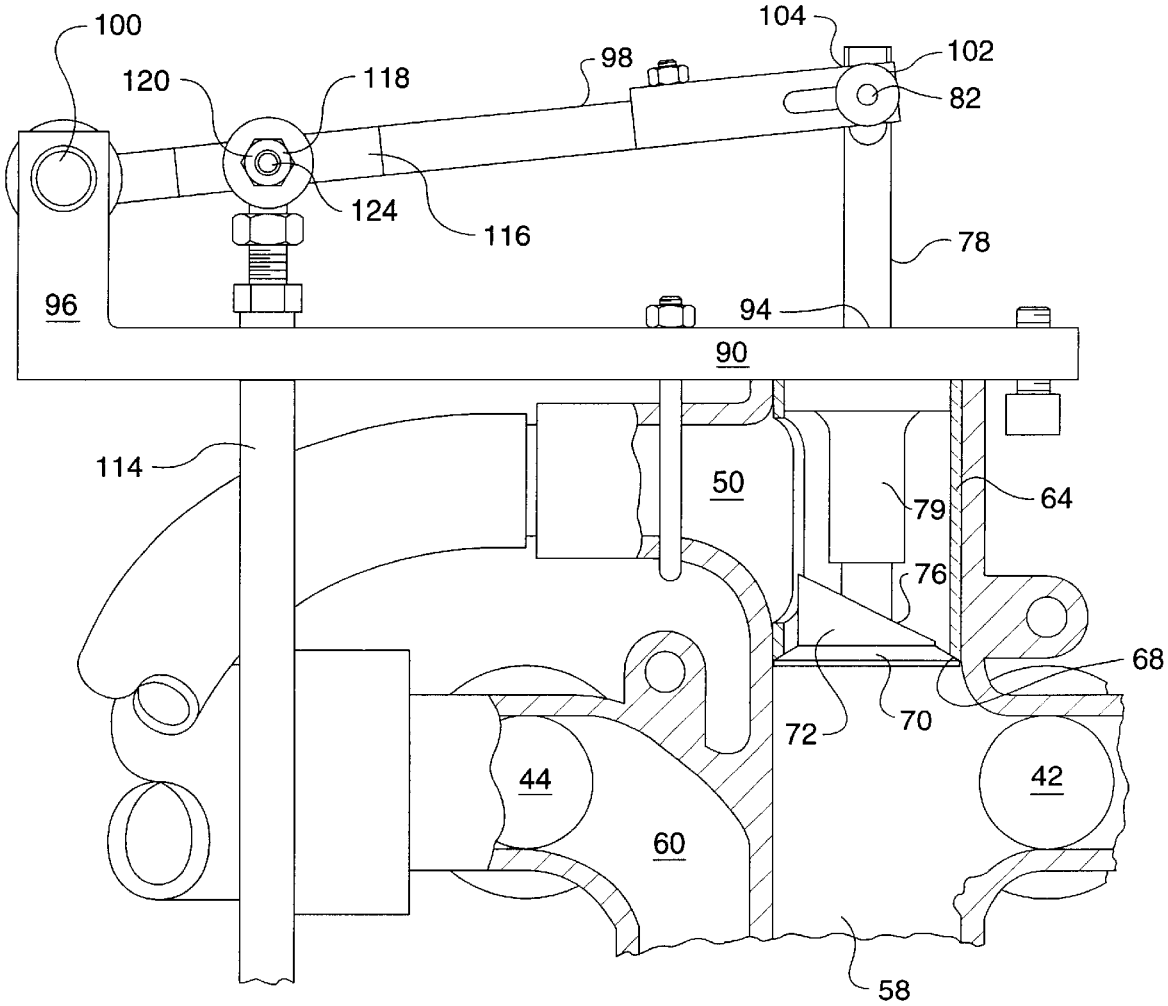
FIG. 6 is a side perspective view the exhaust gas manifold back pressure valve insert assembly, as shown in FIG. 2 and utilized within the exhaust gas recirculation (EGR) loops of FIGS. 1, 3 and 4, and wherein the valve is disposed in its closed state.

As best seen in FIGS. 5 and 6, an actuator slot 116 is prepared in the actuating lever 98. And a nut and bolt assembly 118, 120 attaches the upper end of the actuator rod 114 to the actuating lever 98. A bolt fastener 124, as best seen in FIG. 6, pivotally mounts the actuator rod 114 upon the actuator lever 98. In this manner, when actuating lever 98 is pivotally moved about the axis of the clevis pin 100, actuating lever 98 and actuator slot 116 are able to pivotally move. The actuator slot 116 is used to space the actuating lever 98 from the actuator rod 114 while maintaining a reduced space for the assembly thereof. Ideally, the actuating lever 98 is maintained in an upwardly direction and is fed back to the valve rod 78 ensuring that the peripheral valve seat engagement portion 70 of the valve head 72 is securely seated upon the valve seat 68 when the valve 66 is disposed at its closed position.

INDUSTRIAL APPLICABILITY

When no recirculation of the engine exhaust gases is to take place, the electro-hydraulic actuator 106 is actuated such that the piston rod 112 thereof is fully extended whereby the actuator rod 114 is elevated to its highest extent and the actuating lever 98 is pivotally moved to its upwardly inclined state as shown in FIG. 6. Accordingly, valve stem 78 is caused to be moved to its highest elevation whereby the peripheral valve seat engagement portion 70 of the valve member 66 is caused to be seated upon the valve seat 68 and exhaust gases from the front bank of engine cylinders, that is, cylinders one, two, and three, are prevented from being conducted through exhaust port 50 and toward the EGR cooler 22 and are caused to be exhausted through exhaust port 58. Exhaust gases from the rear bank of engine cylinders, that is, cylinders four, five, and six, are of course already conducted through exhaust port 60, and consequently, all exhaust gases from all six cylinders of the engine are therefore transmitted from inlet ports 40 and 42 and through exhaust ports 44, 46, 58 and 60 toward the turbine stage 24 of the turbocompressor 26.

Figure 7:
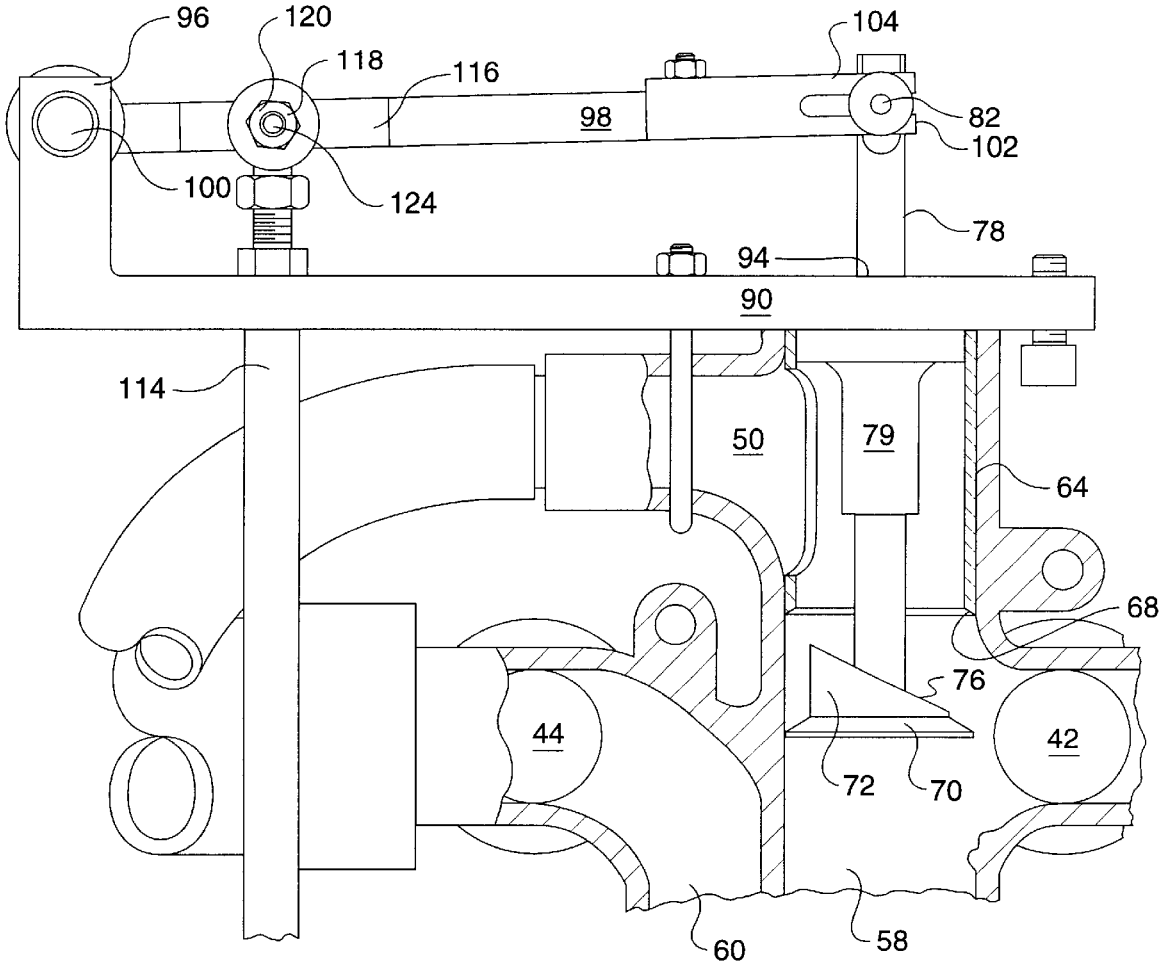
FIG. 7 is a side perspective view similar to that of FIG. 6 showing, the valve disposed in a partially closed state.

When partial recirculation of the engine exhaust gases is taking place, the electro-hydraulic actuator 106 is actuated such that the piston rod 112 thereof is partially contracted whereby the actuator rod 114 is moved downwardly to an intermediate elevational extent and the actuating lever 98 is pivotally moved to a substantially horizontally disposed state as shown in FIG. 7. Accordingly, valve stem 78 is caused to be moved partially downwardly whereby the peripheral valve seat engagement portion 70 of the valve member 66 is now disengaged from the valve seat 68 and a predetermined portion of the exhaust gases from the front bank of engine cylinders is permitted to be conducted from inlet port 42, through elongated exhaust port 74 of the valve sleeve member 64, through exhaust port 50, and out toward the EGR cooler 22 while the remaining portion of the exhaust gases from the front bank of engine cylinders is conducted through exhaust port 58 toward the turbine stage 24 of the turbocompressor 26. All exhaust gases from all three cylinders of the rear bank of engine cylinders continue to be transmitted through exhaust ports 44 and 46 and through exhaust port 60 toward the turbine stage 24 of the turbocompressor 26. In connection with this partial exhaust gas recirculation (EGR) operative mode, it is of course to be understood that only one example of a partial exhaust gas recirculation (EGR) state has been illustrated. In practice, the electro-hydraulic actuator 106 can of course be programmed or controlled so as to achieve any one of a substantially infinite number of extension or contraction states so as to in turn cause a substantially infinite number of partial exhaust gas recirculation (EGR) states.

Figure 8:
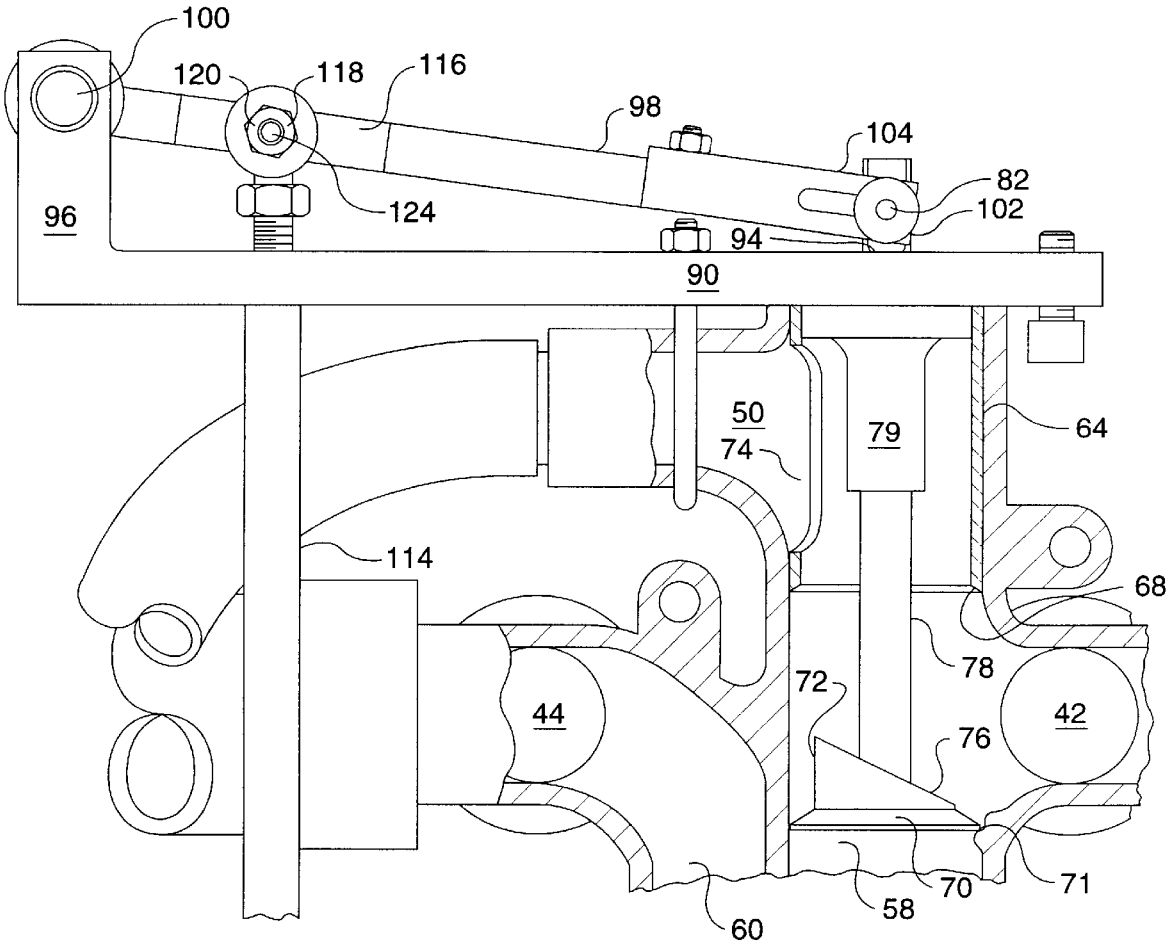
FIG. 8 is a side perspective view similar to that of FIGS. 6 and 7 showing, the valve disposed in a fully open, most restrictive state.

When full exhaust gas recirculation (EGR) is to occur, the electro-hydraulic actuator 106 is actuated further such that the piston rod 112 thereof is fully contracted whereby the actuator rod 114 is moved downwardly to its greatest or lowermost elevational extent and the actuating lever 98 is pivotally moved to a downwardly inclined state as shown in FIG. 8. Accordingly, valve stem 78 is caused to be moved downwardly still further until the peripheral valve seat engagement portion 70 of the valve member 66 is disposed at a position which partially occludes the upper entrance portion to the exhaust port 58. Only an annular space 71 remains between the upper entrance portion of the exhaust port 58 and the peripheral valve seat engagement portion 70 of the valve member 66. Accordingly, such occlusion of the upper entrance portion to the exhaust port 58 serves to develop a significant back pressure with respect to exhaust port 58 and a significant portion of the exhaust gases from the front bank of engine cylinders is effectively forced to be conducted from inlet port 42, through elongated exhaust port 74 of the valve sleeve member 64, through exhaust port 50, and toward the EGR cooler 22. A remaining portion of the exhaust gases from the front bank of engine cylinders is conducted through the aforenoted annular space at the upper entrance portion to the exhaust port 58 and through exhaust port 58 toward the turbine stage 24 of the turbocompressor 26. All exhaust gases from all three cylinders of the rear bank of engine cylinders continue to be transmitted from inlet ports 40 and 42 and through exhaust port 60 toward the turbine stage 24 of the turbocompressor 26.

Thus, it may be seen that as a result of the exhaust gas recirculation (EGR) back pressure valve assembly within the exhaust gas recirculation (EGR) loop of the internal combustion engine, proper or sufficient exhaust gas recirculation (EGR) is able to be readily achieved in a reliable and low-cost manner without the need for separate pumps, venturi mechanisms, or the like. In addition, it is to be remembered that the exhaust gas recirculation (EGR) back pressure valve assembly is not simply an ON-OFF type valve assembly, but to the contrary, as a result of the provision of the electro-hydraulic actuator in conjunction therewith, a substantially infinite number of open positions of the valve member, for achieving a substantially infinite number of degrees of occlusion of the exhaust port for the front bank of engine cylinders, and therefore a substantially infinite number of exhaust gas recirculation (EGR) states, is able to be achieved.

Other aspects objects and advantages of this invention can be obtained from a study of the drawings, the disclosure and the appended claims.

What is claimed is:

1. An exhaust gas recirculation (EGR) system is adapted for use with an internal combustion engine, the exhaust gas recirculation (EGR) system comprising:

an exhaust gas recirculation (EGR) conduit interposed an exhaust manifold structure of the engine and an atmospheric exhaust structure; and a valve mechanism disposed within said exhaust gas recirculation (EGR) conduit and movable between a fully closed position at which an entrance to said exhaust gas recirculation (EGR) conduit is blocked and all exhaust gas from the engine passes to atmospheric exhaust through said atmospheric exhaust structure, and a fully opened position at which said valve mechanism opens said entrance to said exhaust gas recirculation (EGR) conduit and partially occludes said atmospheric exhaust structure such that a sufficiently large back pressure is developed with respect to said atmospheric exhaust structure such that exhaust gases are forced through said exhaust gas recirculation (EGR) conduit.

2. The system as set forth in claim 1, including an actuator operatively connected to said valve mechanism for moving said valve mechanism between said fully opened and fully closed positions.

3. The system as set forth in claim 2, wherein said actuator has an electro-hydraulic actuator having a cylinder and a piston disposed therein wherein upon reception of a generated signal, said piston of said actuator is selectively extended and contracted so as to cause said valve mechanism to achieve any one of a substantially infinite number of positions between said fully closed and fully opened positions.

4. The system as set forth in claim 3, wherein said valve mechanism has a valve stem; and said actuator has a pivotal actuating lever having a first end thereof operatively connected to said valve stem, and an actuator rod operatively connected at a first end thereof to said piston and operatively connected at a second end thereof to a second end of said actuating lever whereupon extension and contraction of said piston, said actuator rod causes pivotal movement of said actuating lever so as to cause movement of said valve mechanism between said fully opened and fully closed positions.

5. The system as set forth in claim 4, wherein said valve mechanism has a valve sleeve and a valve member movable disposed within said valve sleeve;

said valve sleeve has a valve seat defined within an end portion thereof;

said valve member has a head portion having a peripheral region for engaging said valve seat of said valve sleeve; and said second end of said actuator rod is operatively connected to said actuating lever has a load thereon to ensure that said peripheral region of said head portion of said valve member is properly seated upon said valve seat.

6. The system as set forth in claim 4, wherein said valve stem has a transverse rod disposed within a free end portion thereof; and said first end portion of said actuating lever has a dual set of clevis portions wherein said free end portion of said valve stem is interposed a first set of said clevis portions, and said transverse rod of said valve stem is interposed a second set of said clevis portions.

7. The system as set forth in claim 1, including a valve manifold having a first flow path defined therethrough for fluidic connection to a first half of the cylinders of the engine so as to conduct exhaust gases from the first half of the cylinders of the engine to said atmospheric exhaust structure, and a second flow path defined therethrough for fluidic communication to a second half of the cylinders of the engine so as to conduct exhaust gases from the second half of the cylinders of the engine to said atmospheric exhaust structure; and said valve mechanism is disposed within said first exhaust flow path of said valve manifold so as to only control the flow of exhaust gases from a portion of the cylinders of the engine to said atmospheric exhaust structure.

8. The system as set forth in claim 7, wherein said valve manifold has a substantially T-shaped configuration.

9. The system as set forth in claim 7, wherein said valve mechanism has a valve sleeve and a valve member movably disposed within said valve sleeve;

said valve sleeve has a valve seat defined within an end portion thereof, and an exhaust port defined within a side wall portion thereof for conducting exhaust gases to said exhaust gas recirculation (EGR) conduit; and said valve member has a head portion having a peripheral region for engaging said valve seat of said valve sleeve, and a sloped surface for guiding exhaust gases from the portion of the engine cylinders to said exhaust port defined within said side wall of said valve sleeve.

10. The system as set forth in claim 1, including a turbocharger including a turbine stage adapted to be driven by exhaust gases from the engine and a compressor stage for introducing atmospheric air into the engine, said turbine stage of said turbocharger being interposed said valve mechanism and said atmospheric exhaust structure such that the positional disposition of said valve mechanism between said fully opened and fully closed positions determines the amount of exhaust gas transmitted to said turbine stage of said turbocharger and said exhaust gas recirculation (EGR) conduit.

11. An internal combustion engine having an exhaust gas recirculation (EGR) system, said internal combustion engine having a plurality of cylinders, said internal combustion engine comprising:

an intake manifold connected to said cylinders of said internal combustion engine for introducing air into said cylinders of said internal combustion engine;

an exhaust manifold structure connected to said cylinders of said internal combustion engine for conducting exhaust gases from said cylinders of said internal combustion engine;

an exhaust gas recirculation (EGR) conduit interconnecting said exhaust manifold structure of said internal combustion engine to said intake manifold of said internal combustion engine; and a valve mechanism disposed within said exhaust gas recirculation (EGR) conduit and movable between a fully closed position at which an entrance to said exhaust gas recirculation (EGR) conduit is blocked and all exhaust gases from said internal combustion engine pass to atmospheric exhaust through atmospheric exhaust structure, and a fully opened position at which said valve mechanism opens said entrance to said exhaust gas recirculation (EGR) conduit and partially occludes said atmospheric exhaust structure such that a sufficiently large back pressure is developed with respect to said atmospheric exhaust structure such that exhaust gases are forced through said exhaust gas recirculation (EGR) conduit.

12. The internal combustion engine as set forth in claim 11, including an actuator operatively connected to said valve mechanism for moving said valve mechanism between said fully opened and fully closed positions.

13. The internal combustion engine as set forth in claim 12, wherein said actuator has an electro-hydraulic actuator having a cylinder and a piston disposed therein wherein upon reception of a generated signal, said piston of said actuator is selectively extended and contracted so as to cause said valve mechanism to achieve any one of a substantially infinite number of positions between said fully closed and fully opened positions.

14. The internal combustion engine as set forth in claim 13, wherein said valve mechanism has a valve stem; and said actuator has a pivotal actuating lever having a first end thereof operatively connected to said valve stem, and an actuator rod operatively connected at a first end thereof to said piston and operatively connected at a second end thereof to a second end of said actuating lever whereupon extension and contraction of said piston, said actuator rod causes pivotal movement of said actuating lever so as to cause movement of said valve mechanism between said fully opened and fully closed positions.

15. The internal combustion engine as set forth in claim 14, wherein said valve mechanism has a valve sleeve and a valve member movably disposed within said valve sleeve;

said valve sleeve has a valve seat defined within an end portion thereof;

said valve member has a head portion having a peripheral region for engaging said valve seat of said valve sleeve; and said second end of said actuator rod is operatively connected to said actuating lever and said valve stem has a preload thereon to ensure that said peripheral region of said head portion of said valve member is properly seated upon said valve seat.

16. The internal combustion engine as set forth in claim 14, wherein said valve stem has a transverse rod disposed within a free end portion thereof; and said first end portion of said actuating lever has a dual set of clevis portions wherein said free end portion of said valve stem is interposed a first set of said clevis portions, and said transverse rod of said valve stem is interposed a second set of said clevis portions.

17. The internal combustion engine as set forth in claim 11, including a valve manifold having a first flow path defined therethrough for fluidic connection to a first portion of the plurality of cylinders of the engine so as to conduct exhaust gases from the portion of the cylinders of the engine to said atmospheric exhaust structure, and a second flow path defined therethrough for fluidic communication to a second portion of the plurality of cylinders of the engine so as to conduct exhaust gases from the second portion of the plurality of cylinders of the engine to said atmospheric exhaust structure; and said valve mechanism is disposed within said first exhaust flow path of said valve manifold so as to only control the flow of exhaust gases from the portion of the cylinders of the engine to said atmospheric exhaust structure.

18. The internal combustion engine as set forth in claim 17, wherein said portion of the cylinders is one half of said total number of cylinders.

19. The internal combustion engine as set forth in claim 17, wherein:

said valve mechanism has a valve sleeve and a valve member movably disposed within said valve sleeve;

said valve sleeve has a valve seat defined within an end portion thereof, and an exhaust port defined within a side wall portion thereof for conducting exhaust gases to said exhaust gas recirculation (EGR) conduit; and said valve member has a head portion having a peripheral region for engaging said valve seat of said valve sleeve, and a sloped surface for guiding exhaust gases from the portion of the engine cylinders to said exhaust port defined within said side wall of said valve sleeve.

20. The internal combustion engine as set forth in claim 11, including a turbocharger having a turbine stage adapted to be driven by exhaust gases from the engine and a compressor stage for introducing atmospheric air into the engine, said turbine stage of said turbocompressor being interposed said valve mechanism and said atmospheric exhaust structure such that the positional disposition of said valve mechanism between said fully opened and fully closed positions determines the amount of exhaust gas transmitted to said turbine stage of said turbocompressor and said exhaust gas recirculation (EGR) conduit.

21. A method of providing exhaust gas. recirculation to an internal combustion engine, said internal combustion engine having a plurality of cylinders, an atmospheric exhaust structure, an intake manifold, a first exhaust manifold being in fluid communication with a first portion of said plurality of cylinders, and a second exhaust manifold being in fluid communication with a second portion of said plurality of cylinders; said method comprising the steps of:

providing a conduit being interposed one of said first portion of said plurality of cylinders and said second portion of said plurality of cylinders and said intake manifold;

providing a valve mechanism in said conduit;

moving said valve mechanism into a closed position during an operating mode of said internal combustion engine so that an exhaust gas from said plurality of cylinders is directed to said atmospheric exhaust structure;

moving said valve mechanism into an open position during an operating mode of said internal combustion engine so that said exhaust gas from one of said first portion and said second portion creating a large back pressure with respect to an exhaust gas within said atmospheric exhaust structure and being directed to said intake manifold; and moving said valve mechanism into a position intermediate said open position and said closed position during an operating mode of said internal combustion engine so that a predetermined quantity of said exhaust gas from one of said first portion and said second portion creating a large back pressure with respect to an exhaust gas within said atmospheric exhaust structure being directed to said intake manifold.

* * * * *